US005435932A

United States Patent [19]

Bryant et al.

[11] Patent Number: 5,435,932

[45] Date of Patent: Jul. 25, 1995

[54] ELECTRORHEOLOGICAL FLUIDS CONTAINING ELETRONICALLY CONDUCTIVE POLYMERS

[75] Inventors: Charles P. Bryant, Euclid; Kasturi Lal, Willoughby; Joseph W. Pialet, Euclid, all of Ohio

[73] Assignee: The Lubrizol Corporation, Wickliffe, Ohio

[21] Appl. No.: 166,776

[22] Filed: Dec. 14, 1993

Related U.S. Application Data

[63] Continuation-in-part of Ser. No. 774,397, Oct. 10, 1991, abandoned.

[51] Int. Cl.[6] ..... C10M 171/00; C10M 169/04

[52] U.S. Cl. ..... 252/77; 252/73; 252/572

[58] Field of Search ..... 252/77, 73, 572

[56] References Cited

U.S. PATENT DOCUMENTS

| | | | |
|---|---|---|---|
| 3,654,187 | 4/1972 | Takenaka et al. | 252/511 |
| 4,687,589 | 8/1987 | Block et al. | 252/73 |
| 5,108,639 | 4/1992 | Block et al. | 252/77 |
| 5,171,478 | 12/1992 | Han | 252/500 |

FOREIGN PATENT DOCUMENTS

| | | |
|---|---|---|
| 0298746 | 1/1989 | European Pat. Off. . |
| 0395359 | 10/1990 | European Pat. Off. . |
| 0432601 | 6/1991 | European Pat. Off. . |
| 0432929 | 6/1991 | European Pat. Off. . |
| 63-97694 | 4/1988 | Japan . |
| 64-050213 | 1/1989 | Japan . |
| 64-237828 | 7/1989 | Japan . |
| 1172496 | 7/1989 | Japan . |
| 3-33194 | 2/1991 | Japan . |
| 3-139598 | 6/1991 | Japan . |
| 2230532 | 10/1990 | United Kingdom . |
| WO8901694 | 2/1989 | WIPO . |
| WO9001775 | 2/1990 | WIPO . |
| WO9002763 | 3/1990 | WIPO . |
| 90/10297 | 9/1990 | WIPO . |
| WO9105979 | 5/1991 | WIPO . |
| WO9111480 | 8/1991 | WIPO . |

OTHER PUBLICATIONS

Block et al, in Proc. First Intl. Symposium on Electrorheological Fluids, P. et seq., Aug. 1989.
Clark et al, Synthetic Metals 29 p. E337, 1989.
Kathirgamanathan et al, J. Mater. Chem. 1 p. 141, 1991.
Leclerc et al, Macromolecules 22 p. 649, 1989.
Neoh et al, J. Macromol. Sci. —Chem. A27 p. 933, 1990.
Wei et al, J. Phys. Chem. 93 pp. 495–499, 1989.
Block et al, Langmuir 6, p. 6, 1990.
Block et al, J. Phys. D Appl. Phys 21 p. 1661, 1988.
Tan et al, J. Phys Chem. Solids 52 p. 673, 1991.
Cao et al, Polymer 30 p. 2305, 1989.
Armes et al, Synthetic Metals, 22 p. 385, 1988.
Malsepulo "Structure Formation in and Electric Field and the Composition of Electrorheological Suspensions", translated from Elektroreol. Issled, Pril., Minsk pp. 27–51, 1991.
Gow et al, "The Electrorheological Proporties of Polyanilne Suspensions,"J. Colloid and Interface Science, vol. 136, No. 1, Apr. 1990, pp. 175–188.

*Primary Examiner*—Christine Skane
*Attorney, Agent, or Firm*—David M. Shold; Frederick D. Hunter Sr.

[57] ABSTRACT

Non-aqueous electrorheological fluids are described which comprise a major amount of a hydrophobic liquid phase and a minor amount of a dispersed particulate phase comprising conductive polymers selected from the group consisting of polypyrroles, polyphenylenes, polyacetylenes, polyvinylpyridines, polyvinylpyrrolidones, poly(substituted anilines), polyvinylidene halides, polyphenothiazines and polyimidazoles. The electrorheological fluids prepared in accordance with the present invention are useful in a variety of applications including flotational coupling devices such as clutches for automobiles or industrial motors, transmissions, brakes or tension control devices; and linear damping devices such as shock absorbers, engine mounts and hydraulic actuators.

51 Claims, No Drawings

ELECTRORHEOLOGICAL FLUIDS CONTAINING ELETRONICALLY CONDUCTIVE POLYMERS

This application is a continuation-in-part of application Ser. No. 07/774,397, filed on Oct. 10, 1991, now abandoned the disclosure of which is incorporated herein by reference.

FIELD OF THE INVENTION

This invention relates to electrorheological fluids. More particularly, this invention relates to electrorheological fluids containing certain electronically conductive polymers as the dispersed particulate phase.

BACKGROUND OF THE INVENTION

Electrorheological (ER) fluids are dispersions which can rapidly and reversibly vary their apparent viscosity in the presence of an applied electric field. The electrorheological fluids are dispersions of finely divided solids in hydrophobic, electrically non-conducting oils and such fluids have the ability to change their flow characteristics, even to the point of becoming solid, when subjected to a sufficiently strong electrical field. When the field is removed, the fluids revert to their normal liquid state. Electrical DC fields and also AC fields may be used to effect this change. The current passing through the electrorheological fluid is extremely low. Thus, ER fluids are used in applications in which it is desired to control the transmission of forces by low electric power levels such as, for example, clutches, hydraulic valves, shock absorbers, vibrators or systems used for positioning and holding work pieces in position.

U.S. Pat. No. 2,417,508 (issued in 1947 to Willis M. Winslow) disclosed that certain dispersions composed of finely divided solids such as starch, carbon, limestone, gypsum, flour, etc., dispersed in a non-conducting liquid such as a lightweight transformer oil, olive oil or mineral oil, etc., would undergo an increase in flow resistance when an electrical potential difference was applied to the dispersion. This observation has been referred to as the Winslow Effect. Subsequently, investigators demonstrated that the increase in the flow resistance was due not only to an increase in the viscosity, in the Newtonian sense, but also to rheological changes in which the fluid displays a positive yield stress in the presence of an electric field. This relationship is often described using the Bingham plastic model. Yield stress is the amount of stress which must be exceeded before the system moves or yields. The yield stress is a function of electric field and has been reported to be linear or quadratic, depending on fluid composition and the experimental techniques. Measurement of yield stress can be achieved by extrapolation of stress vs. strain curves, sliding plate, controlled stress, or capillary rheometers.

The efficiency of the electrorheological fluid is related to the amount of electrical power required to affect a given change in rheological properties. This is best characterized as the power required for an observed ratio of yield stress under field to the viscosity of the fluid in the absence of a field. From fluid requirements vs. device design considerations, a parameter has been defined as the dimensionless Winslow number, Wn, where;

$$Wn = \frac{(YS)^2}{(PD)(\eta o)}$$

Electrorheological fluids which have been described in the literature can be classified into two general categories: water containing, and those which do not require water. Although fluids were known to function without water, for many years, it was believed that ER fluids had to contain small quantities of water which were believed to be principally associated with the dispersed phase to exhibit significant ER properties. However, from an application standpoint, the presence of water generally is undesirable since it may result in corrosion, operating temperature limitations (loss of water at higher temperatures), and significant electrical power consumption.

The present invention is concerned primarily with the preparation of ER fluids which do not contain significant amounts of water and these are hereinafter termed non-aqueous or substantially anhydrous ER fluids. Several patents and publications in the last five years have described non-aqueous ER fluids in which electronically conductive polymers have been utilized as the dispersed particulate phase. U.S. Pat. No. 4,687,589 (Block et al) describes an electrorheological fluid which comprises a liquid continuous phase and, dispersed therein, at least one dispersed phase which is capable of functioning as such when at least the dispersed phase is substantially anhydrous. Preferably, the ER fluid is one which is capable of functioning as such when the fluid itself is substantially anhydrous. The term "anhydrous" in relation to the dispersed phase is defined as the phase obtained after catalyst removal, which is dried under vacuum at 70° C. for three days to a constant weight. In relation to the continuous phase, an anhydrous continuous phase is defined as the phase dried by passage, at an elevated temperature (for example, 70° C.) if required, through an activated alumina column. The dispersed phase described in this patent is an electronic conductor which is a material through which electricity is conducted by means of electrons (or holes) rather than by means of ions. Examples of such phases include semi-conductors, particularly organic semi-conductors. The semi-conductors are defined as materials having an electric conductivity at ambient temperature of from $10^0$ to $10^{-11}$ mho/cm, and a positive temperature-conductivity coefficient. The organic semi-conductors described in this patent include materials which comprise an unsaturated fused polycyclic system such as violanthrone B. The aromatic fused polycyclic systems may comprise at least one heteroatom such as nitrogen or oxygen. Phthalocyanine systems such as a metallophthalocyanine systems are particularly preferred. Another class of electronic conductors described in this patent include fused polycyclic systems such as poly(acene-quinone) polymers which may be prepared by condensing at least one substituted or unsubstituted acene such as by phenyl, terphenyl, naphthylene, etc., with at least one substituted or unsubstituted polyacylated aromatic compound such as a substituted or unsubstituted aromatic polycarboxylic acid in the presence of a Lewis acid such as zinc chloride. Schiff's Bases are also described as suitable organic semi-conductors. The Schiff's Bases may be prepared by reacting polyisocyanates with quinones. Aniline black, prepared, for example, by oxidizing aqueous aniline hydrochloride with sodium chlorate is another example of such an organic semi-conductor. The patentees also indicate that other classes of suitable organic semi-conductors are described by H. A. Pohl et al in J. Phys. Chem., 66, (1962) pp. 2085–2095.

More recently, the use of polyaniline suspensions as electrorheological fluids was described by Gow and Zukowski in "The Electrorheological Properties of Polyaniline Suspensions", J. Colloid and Interface Science, Vol. 126, No. 1, April 1990, pp. 175–188. The authors describe the electrorheological properties of suspensions containing polyaniline particles in silicon oil for a range of suspension volume fractions, applied field strengths, shear stresses, and particle dielectric constants. The polyaniline utilized in the studies was synthesized by adding aniline to chilled aqueous hydrochloric acid followed by the addition of an aqueous ammonium peroxydisulfate solution of the same temperature. The initial reactant concentrations were 0.55 mole aniline, 0.1 mole of the ammonium peroxydisulfate and one mole of hydrochloric acid. The polyaniline solids obtained in this manner were divided into four portions, and an aqueous suspension was prepared from each portion and adjusted with sodium hydroxide to a desired pH (i.e., 6,7,8 and 9). The pH of the suspensions was adjusted over a period of days until they remained constant for 24 hours. The hydrophobic powders were then recovered and washed. The authors concluded that suspensions composed of the polyaniline particles in polydimethyl silicone showed a substantial ER response.

In European patent application 394,005 (corresponding to GB 2,230,532) published on Oct. 24, 1990, Block et al describe an electrorheological fluid which consists of silicone oil containing 30 volume percent of dispersed polyaniline. The polyaniline is acidically oxidized aniline prepared by adding aniline (1.2 moles) to a continuously stirred and cooled solution (0°–5° C.) of ammonium persulfate (1.2 moles) in 1500 ml. of 2M hydrochloric acid solution. After drying and grinding, the black polyaniline powder was treated with sodium or ammonium hydroxide in different amounts and for different periods of time. The base-treated polyanilines prepared in this manner were reported to be useful in ER fluids.

European Patent Application 387857 (published Sep. 19, 1990) describes ER fluids comprising an insulated liquid and solid electrolyte particles which may be various inorganic materials or organic polymers. Alkali metal salts of polyethylene oxide complexes and alkali halide-crown ether complexes are given as examples of such polymers.

Japan Hei 3-33194 published Feb. 13, 1991 describes electrorheological fluids containing dispersed organic polymers. The polymers described in this publication are polypyrrole, polydibromothiophene and poly-p-phenylene.

Japan 3139598 published Jun. 13, 1991, describes ER fluids containing organic conductive polymers and electrically insulating oils. The conductive polymer is preferably obtained by subjecting a polymer, obtained by oxidation polymerization, to a dope-removing treatment, or a polymer obtained by treating polyaniline with alkali. Preferably the polymer powder has an insulating layer on its surface. Preferred polymers include polyaniline, polypyrrole, polythiophene and their derivatives.

SUMMARY OF THE INVENTION

Non-aqueous electrorheological fluids are described which comprise a hydrophobic liquid phase and a dispersed particulate phase comprising conductive polymers selected from the group consisting of polypyrroles, polyphenylenes, polyacetylenes, polyvinylpyridines, polyvinylpyrrolidones, poly(substituted anilines), polyvinylidene halides, polyphenothiazines and polyimidazoles. The electrorheological fluids prepared in accordance with the present invention are useful in a variety of applications including flotational coupling devices such as clutches for automobiles or industrial motors, transmissions, brakes or tension control devices; and linear damping devices such as shock absorbers, engine mounts and hydraulic actuators.

DETAILED DESCRIPTION OF THE INVENTION

Unless otherwise specified in the disclosure and claims, the following definitions are applicable. The term "hydrocarbyl" denotes a group or substituent having a carbon atom directly attached to the remainder to the molecule and having predominantly hydrocarbon character.

Examples of hydrocarbyl groups or substituents which can be useful in connection with the present invention include the following:

(1) hydrocarbon groups or substituents, that is aliphatic (e.g., alkyl or alkenyl), alicyclic (e.g., cycloalkyl, or cycloalkenyl) substituents, aromatic, aliphatic and alicyclic-substituted aromatic nuclei and the like, as well as cyclic substituents wherein the ring is completed through another portion of the molecule (that is, for example, any two indicated substituents may together form an alicyclic group);

(2) substituted hydrocarbon groups or substituents, that is, those containing nonhydrocarbon substituents which, in the context of this invention, do not alter the predominantly hydrocarbon character of the substituted group or substituent and which do not interfere with the reaction of a component or do not adversely affect the performance of a material when it is used in an application within the context of this invention; those skilled in the art will be aware of such groups (e.g., alkoxy, carbalkoxy, alkylthio, sulfoxy, etc.);

(3) hetero groups or substituents, that is, groups or substituents which will, while having predominantly hydrocarbon character, contain atoms other than carbon present in a ring or chain otherwise composed of carbon atoms. Suitable heteroatoms will be apparent to those of ordinary skill in the art and include, for example, sulfur, oxygen, and nitrogen. Moieties such as pyridyl, furanyl, thiophenyl, imidazolyl, and the like, are exemplary of hetero groups or substituents. Up to two heteroatoms, and preferably no more than one, can be present for each 10 carbon atoms in the hydrocarbon-based groups or substituents.

Typically, the hydrocarbon-based groups or substituents of this invention are essentially free of atoms other than carbon and hydrogen and are, therefore, purely hydrocarbon.

Hydrophobic Liquid Phase

The non-aqueous electrorheological fluids of the present invention comprise a hydrophobic liquid phase which is a non-conducting, electric insulating oil or an oil mixture. Examples of insulating oils include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, and mixtures thereof. The choice of the hydrophobic liquid phase will depend in part upon the intended utility of the ER fluid. For example, the hydrophobic liquid should be compatible with the environment in which it will be used. If the ER fluid is to be in contact with elastomeric materials, the hydrophobic liquid phase should not contain oils or solvents which attack or swell, or, in some cases even dissolve elastomeric materials. Additionally, if the ER fluid is to be subject to a wide temperature range of, for example, from about −50° C. to about 150° C., the hydrophobic liquid phase should be selected to provide a liquid and chemically stable ER fluid over this temperature range and should exhibit an adequate electrorheological effect over this temperature range. Suitable hydrophobic liquids include those which are characterized as having a viscosity at room temperature of from about 2 to about 300 centipoise. In another embodiment, low viscosity oils such as those having a viscosity at room temperature of from 2 to about 20 centipoises are preferred.

Liquids useful as the hydrophobic continuous liquid phase generally are characterized as having as many of the following properties as possible: (a) high boiling point and low freezing point; (b) low viscosity so the ER fluid has a low no-field viscosity and greater proportions of the solid dispersed phase can be included in the fluid; (c) high electrical resistance and high dielectric strength so that the fluid will draw little current and can be used over a wide range of applied electric field strengths; and (d) chemical and thermal stability to prevent degradation on storage and service.

Oleaginous liquids such as petroleum derived hydrocarbon fractions may be utilized as the hydrophobic liquid phase in the ER fluids of the invention. Natural oils are useful and these include animal oils and vegetable oils (e.g., castor, lard oil, sunflower oil) liquid petroleum oils and hydrorefined, solvent-treated or acid-treated mineral lubricating oils of the paraffinic, naphthenic and mixed paraffinic-naphthenic types. Oils derived from coal or shale are also useful oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols and polyols (e.g., butyl alcohol, hexyl alcohol, dodecyl alcohol, 2-ethylhexyl alcohol, ethylene glycol, diethylene glycol, monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Polyalphaolefins and hydrogenated polyalpha olefins (referred to in the art as PAO) are useful in the ER fluids of the invention. PAOs are derived from alpha olefins containing from 2 to about 24 or more carbon atoms such as ethylene, propylene, 1-butene, isobutene, 1-decene, etc. Specific examples include polyisobutylene having a number average molecular weight of 650; a hydrogenated oligomer of 1-decene having a viscosity at 100° C. of 8 cst; ethylene-propylene copolymers; etc. An example of a commercially available hydrogenated polyalphaolefin is Emery 3004.

Silicon-based oils such as the polyalkyl-, polyaryl-, polyalkoxy-, or polyaryloxysiloxane oils and silicate oils comprise a particularly useful class of synthetic oils. These oils include tetraethyl silicate, tetraisopropyl silicate, tetra-(2-ethylhexyl) silicate, tetra-(4-methyl-2-ethylhexyl) silicate, tetra-(p-terbutylphenyl) silicate, hexa-(4-methyl-2-pentoxy) disiloxane, poly(methyl) siloxanes and poly(methylphenyl) siloxanes. The silicone oils are useful particularly in ER fluids which are to be in contact with elastomers.

Other synthetic oils include liquid esters of phosphorus-containing acids such as tricresyl phosphate, trioctyl phosphate and the diethyl ester of decylphosphonic acid.

Specific examples of hydrophobic liquids which may be utilized in the ER fluids of the present invention include, for example, mineral oil, di-(2-ethylhexyl) adipate; di-(2-ethylhexyl) maleate; dibenzylether, dibutylcarbitol; di-2-ethylhexyl phthalate; 1,1-diphenylethane; tripropylene glycol methyl ether; butyl cyclohexyl phthalate; di-2-ethylhexyl azelate; tricresyl phosphate; tributyl phosphate; tri(2-ethylhexyl) phosphate; pentachlorophenyl phenyl ether; brominated diphenyl methanes; olive oil; xylene; toluene, etc. Commercially available oils which may be used in the ER fluids of the invention include: Trisun 80, a high oleic sunflower oil from The Lubrizol Corporation; Emery 3004, a hydrogenated polyalpha olefin; Emery 2960, a synthetic hydrocarbon ester; and Hatco HXL 427, believed to be a synthetic ester of a monocarboxylic acid and a polyol.

The amount of hydrophobic liquid phase in the ER fluids of the present invention may range from about 20% to about 90 or 95% by weight. Generally, the ER fluids will contain a major amount (i.e., at leasdt 51%) of the hydrophobic liquid phase. More often, the hydrophobic liquid phase will comprise from about 60 to about 80 or 85% by weight of the ER fluid.

The Conductive Polymer Dispersed Particulate Phase

The conductive polymers which may be utilized as the dispersed particulate phase in the ER fluids of the present invention may be polypyrroles, polyphenylenes, polyacetylenes, polyvinylpyridines, polyvinylpyrrolidones, poly(substituted anilines), polyvinylidines, halides, polyphenothiazines, polyimidazoles, and mixtures thereof. The ER fluids of the present invention generally will contain a minor amount (i.e., up to about 49%) of the dispersed particulate phase although the ER fluids of the present invention more often will contain from about 5 to about 40% by weight of the conductive polymer dispersed phase. In one preferred embodiment, the ER fluids will contain from about 20 to about 40% by weight of the conductive polymers.

In one embodiment, the conductive polymers useful in the ER fluids of the present invention are selected from the group consisting of poly(substituted pyrroles), polyphenylene oxides, polyphenylene sulfides, polyacetylenes, polyvinylpyridines, polyvinylpyrrolidones, poly(substituted anilines), polyvinylidine halides, polyphenothiazines, polyimidazoles and mixtures thereof.

In yet another embodiment, the conductive polymers useful as the dispersed particulate phase in the ER fluids of the present invention are derivatives obtained by treating a pyrrole, poly(substituted aniline), polyvinylpyridine, polyvinylpyrrolidone, polyimidazoline, polyphenothiazine, polyphenylene oxide, polyphenylene sulfide, or mixtures thereof with an amount of an acid, halogen, sulfur, sulfur halide, sulfur oxide or a hydrocarbyl halide to form a derivative compound having a desired conductivity.

Polypyrroles, including polymers of substituted pyrrole and copolymers of pyrrole and other copolymerizable monomers represent one class of conductive polymers useful in the present invention. The term "polypyrrole" means polymers containing polymerized pyrrole rings including substituted pyrrole rings such as those represented by the following formula

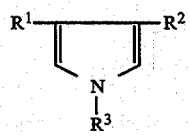

(I)

wherein $R^1$, $R^2$ and $R^3$ are each independently hydrogen or a lower alkyl group containing from 1 to about 7 carbon atoms. Examples of lower alkyl groups include methyl, ethyl, n-propyl, i-propyl, etc. In one preferred embodiment, $R^1$, $R^2$ and $R^3$ are independently methyl groups. Examples of such pyrroles include N-methyl pyrrole and 3,4-dimethyl pyrrole. Copolymers of pyrrole and N-methyl pyrrole or 3,4-dimethyl pyrrole can be used in the present invention. Alternatively, pyrrole or substituted pyrroles of the type represented by Formula (I) can be copolymerized with other copolymerizable monomers, and in particular, other heterocyclic ring compounds including those containing nitrogen such as pyridine, aniline, indole, imidazole, etc., furan and thiophene, or with other aromatic or substituted aromatic compounds.

Polymers and copolymers of pyrrole are available commercially from a variety of sources or may be manufactured by techniques well known to those skilled in the art. For example, polymers of pyrrole can be obtained by electropolymerization as reported in U.K. Patent 2,184,738 and by Diaz et al, *J. Chem. Soc., Chem. Comm.*, 635 (1979) and in *J. Chem. Soc., Chem. Comm.*, 397 (1980). Polypyrrole is electrically conducting in the charged or oxidized state (black), and produced in this state by electropolymerization. If polypyrrole is completely reduced to the neutral or discharge state (yellow), it is an electronic insulator. Polypyrrole, and in particular, pyrrole black can be formed as a polymeric powdered material by oxidizing pyrrole in homogeneous solution (e.g., with hydrogen peroxide). Gardini in *Adv. Heterocyl. Chem.*, 15, 67 (1973) describes such a process and product. Pyrrole can also be oxidized into a polypyrrole with other oxidizing agents such as ferric chloride. Porous electronically conducting compositions comprising an electropolymerized polypyrrole or a copolymer of a pyrrole useful as the dispersed particulate phase in the ER fluids of the present invention are described in U.K. 2,184,738, the disclosure of which is hereby incorporated by reference. Briefly, the process described therein comprises electropolymerization of a pyrrole or a copolymerizable mixture containing a pyrrole at an electronically conductive surface in an electrolytic bath by (A) immersing an electronically conductive surface in an electrolytic bath comprising (i) a pyrrole or a mixture of a pyrrole with a copolymerizable monomer, (ii) one or more low mobility anions which are incorporated into the polypyrrole or copolymer of pyrrole and which are characterized by an average ionic transference number for said low mobilility anions during reduction of the polypyrrole or copolymer of less than about 0.1, and (iii) an organic diluent, and (B) passing an electric current through said bath at a voltage sufficient to electropolymerize the pyrrole or copolymerizable mixture containing pyrrole at the electronically conductive surface.

The low mobility anions which are incorporated into the compositions may be either organic or inorganic ions. Examples of low mobility of inorganic ions described therein include transition metal complexes such as ferricyanide, nitroprusside, etc. Preferred low mobility anions are organic anions including those derived from organic sulfates or sulfonates which may be alkyl, cycloalkyl, aryl alkyl or alkaryl sulfates and sulfonates. The anions may contain more than one anionic site, i.e., more than one ionizable group per molecule, e.g., more than one sulfonic acid group per molecule. Examples of sulfonic acids include hexyl sulfonic acid, octyl sulfonic acid, dodecyl sulfonic acid, benzene sulfonic acid, toluene sulfonic acid, etc. Examples of sulfates include alkyl sulfates such as lauryl hydrogen sulfate and polyethylene hydrogen sulfates of various molecular weights.

Polyphenylenes are also useful as the dispersed particulate phase in the ER fluids of the present invention. The term "polyphenylenes" as used herein and in the claims is intended to include polyphenylene, polyphenylene sulfide and polyphenylene oxide.

The conductive polymers useful in the present invention also may comprise polyacetylenes. Polyacetylenes can be prepared by processes known to those skilled in the art, and polyacetylenes of various molecular weights may be utilized in the ER fluids of the present invention as the dispersed particulate phase.

The polyvinylpyridines which may be utilized as the dispersed particulate phase in the ER fluids of the present invention include polymers of vinylpyridine and substituted vinylpyridine as well as copolymers with pyridine, substituted vinylpyridines, and/or other copolymerizable monomers such as styrene, acrylic acid, acrylic esters, etc. The polymers and copolymers useful in the present invention may be derived from 2-vinylpyridine as well as 4-vinylpyridine. Such polymers and copolymers of vinylpyridine are available commercially from such sources as Aldrich Chemical Company, Polyscience, etc.

Polymers of other heterocyclic nitrogen-containing compounds are also useful, and these include polyvinylpyrrolidones, polyimidazoles and polyphenothiazines. Particularly useful are polymers of 1-vinyl-2-pyrrolodinone, imidazole, 1-vinylimidazole, and phenothiazine. Several polyvinyl pyrrolidones are available commercially from Aldrich Chemical Company including powders having average molecular weights of 10,000, 24,000, 40,000 and 360,000. Copolymers of vinylpyrrolidone also may be used and these include, such commercially available copolymers as: 1 -vinylpyrrolidone/2-dimethylaminoethylmethacrylate copolymer; 1-vinylpyrrolidone/vinyl acetate copolymer; etc.

Polyvinylidine halides which are useful as the dispersed particulate phase in the ER fluids of the present invention include poly(vinylidine fluoride), poly(vinylidine chloride), etc. Polyvinylidine halides have been described in the literature and some are available commercially. For example, poly(vinylidine fluoride) is available from Aldrich Chemical Company.

The poly(substituted anilines) useful as the dispersed particulate phase in the ER fluids of the present invention may be derived from ring-substituted anilines as well as N-substituted anilines. In one embodiment, the poly(substituted anilines) are derived from at least one substituted aniline characterized by the formula

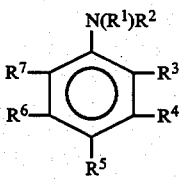

(II)

wherein $R^1$ is hydrogen, a hydrocarbyl group or an acyl group, $R^2$ is hydrogen or a hydrocarbyl group, $R^3$–$R^7$ are each independently hydrogen or an alkyl, halo, CN, OR*, SR*, $NR^*_2$, $NO_2$, COOR*, or $SO_3H$ group, and each R* is independently hydrogen or a hydrocarbyl group, provided that at least one of $R^1$–$R^7$ is not hydrogen and at least one of $R^3$–$R^7$ is hydrogen.

The substituent $R^1$ may be hydrogen, a hydrocarbyl group or an acyl group. The hydrocarbyl group may be an aliphatic or aromatic hydrocarbyl group such as methyl, ethyl, propyl, phenyl, substituted phenyl, etc. The acyl group may be represented by the formula RC(O)— wherein R is an aliphatic or aromatic group, generally aliphatic. Preferred aliphatic groups include methyl and ethyl.

At least one of $R^1$–$R^7$ in the substituted anilines of Formula (II) is a substituent other than hydrogen as defined above. Thus, the substituent may be an alkyl group, particularly a lower alkyl group such as methyl, ethyl, propyl, etc. Alternatively, the group may be a halo group, a cyano group, a hydroxy group, mercapto group, amino group, nitro group, carboxy group, sulfonic acid group, a hydrocarbyloxy group, a hydrocarbylthio group, etc. The hydrocarbyl groups preferably are aliphatic groups, and more preferably lower aliphatic groups containing from 1 to about 7 carbon atoms.

In preferred embodiments, at least one of $R^3$ or $R^5$ is hydrogen, and in another embodiment, $R^1$ and $R^2$ also are hydrogen. In another preferred embodiment, $R^1$, $R^4$ or $R^5$ is an alkyl group, an OR* group or COOH group, and the remainder of $R^1$ through $R^7$ are hydrogen. Preferably, the alkyl groups $R^3$, $R^4$ or $R^5$ are methyl groups.

In another embodiment, the substituted aniline may be represented by the formula

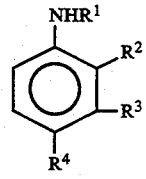

(IIA)

wherein $R^1$ is hydrogen, a hydrocarbyl or an acyl group, $R^2$–$R^4$ are each independently hydrogen, or an alkyl, halo, cyano, OR*, SR*, $NR^*_2$, $NO_2$, COOR*, or $SO_3H$ group, and each R* is independently hydrogen or a hydrocarbyl group provided that at least one of $R^1$–$R^4$ is not hydrogen.

Specific examples of substituted anilines which can be polymerized to poly(substituted anilines) useful in the present invention include o-toluidine, o-ethylaniline, m-toluidine, o-chloroaniline, o-nitroaniline, anthranilic acid, o-cyanoaniline, N-methylaniline, N-ethylaniline, acetanilide, m-acetotoluidine, o-acetotoluidide, p-aminodiphenylamine, benzanilide, 2'-hydroxy-5'-nitroacetanilide, 2-bromo-N-N-dimethylaniline, 4-chloroacetanilide, 4-acetamidothioanisole, 4-acetamido-3-nitrobenzoic acid, 4-amino-3-hydroxybenzoic acid, o-methoxyaniline, p-methoxyaniline, 2-nitroaniline, 3-nitroaniline, 4-nitroaniline, 2-methoxy-5-nitroaniline, 2-(methylthio)aniline, 3-(methylthio)aniline, 4-(methylthio)aniline, etc.

The poly(substituted aniline) powders which may be utilized as the dispersed particulate phase in the ER fluids of the present invention are prepared by polymerizing a substituted aniline in the presence of an oxidizing agent and an acid. Generally from about 0.1 to about 2 moles or more, preferably up to about 1.6 moles, and more preferably about one mole of an acid per mole of aniline is used to form an acid salt of the poly(substituted aniline). The poly(substituted anilines) useful as the dispersed particulate phase in the ER fluid of the present invention may also be obtained by polymerizing mixtures of at least one substituted aniline and up to about 50% by weight of another monomer selected from aniline, pyrroles, vinyl pyridines, vinyl pyrrolidones, thiophenes, vinylidene halides, phenothiazines, imidazoles, N-phenyl-p-phenylene diamines or mixtures thereof. For example, the poly(substituted aniline) may be prepared from a mixture of a substituted aniline and up to about 50% by weight of pyrrole or a substituted pyrrole such as N-methylpyrrole and 3,4-dimethylpyrrole.

The polymerization is conducted in the presence of an oxidizing agent. Generally, the polymerization is accomplished in the presence of about 0.8 to about 2 moles of the oxidizing agent per mole of aniline. Various oxidizing agents may be utilized to effect the polymerization of the aniline, and useful oxidizing agents include, peroxides such as sodium peroxide, hydrogen peroxide, benzoyl peroxide, etc; alkali metal chlorates such as sodium chlorate and potassium chlorate; alkali metal perchlorates such as sodium perchlorate and potassium perchlorate; periodic acid; alkali metal iodates and periodates such as sodium iodate and sodium periodate; persulfates such as metal or ammonium persulfates; and chlorates. Alkali metal and alkaline earth metal persulfates may be utilized. The metal and ammonium persulfates, particularly alkali metal or ammonium persulfates are especially useful as the oxidizing agent.

Polymerization of the substituted aniline also is conducted in the presence of an acid. In one embodiment, from about 0.1 to about 2 moles or more of an acid may be used per mole of substituted aniline or mixture of substituted aniline and any of the comonomers described above. In another embodiment, from about 0.8 to about 1.2 or 1.6 moles of acid are utilized per mole of monomer, and in a preferred embodiment, the substituted anilines are polymerized in the presence of approximately equimolar amounts of oxidizing agent and acid.

The acid which is utilized in the polymerization reaction may be an organic acid or an inorganic acid with the inorganic acids generally preferred. Examples of inorganic acids which are useful include mineral acids such as hydrochloric acid, sulfuric acid and phosphoric acid. Hydrochloric acid is one preferred example of an inorganic acid useful in the polymerization of the substituted anilines.

Organic acids which may be used in the polymerization of substituted anilines include, for example, sulfonic acids, sulfinic acids, carboxylic acids and phosphorus acids, and these acids may be alkyl or aryl-substituted acids. Partial salts of said acids also may be used. The organic acids may contain one or more of the sulfonic, sulfinic or carboxylic acid groups, and the acids may, in fact, be polymeric acids as described more fully below. Although the organic acids may contain olefinic unsaturation, it is generally preferred that the organic acids be saturated acids since organic acids containing olefinic unsaturation generally will react with the oxidizing agent thereby diminishing the amount of oxidizing agent available to effect oxidation of the substituted aniline and the resulting polymerization reaction. Accordingly, when the organic acid contains olefinic unsaturation, an excess of the oxidizing agent is generally included in the polymerization mixture. Examples of sulfonic acids which may be utilized include alkyl sulfonic acids such as methane sulfonic acid, ethane sulfonic acid, propane sulfonic acid, hexane sulfonic acid and lauryl sulfonic acid. Examples of aromatic sulfonic acids include benzenesulfonic acid and paratoluenesulfonic acid. The organic phosphorus acids useful in the present invention include alkyl phosphonic acids (e.g., methylphosphonic acid, ethylphosphonic acid), aryl phosphonic acids (e.g., phenyl phosphonic acid), and alkyl phosphinic acids (e.g., dimethylphosphinic acid).

Examples of carboxylic acids include alkyl carboxylic acids such as propanoic acid, hexanoic acid, decanoic acid and succinic acid. Examples of aromatic carboxylic acids include benzoic acid.

In another embodiment, the organic acid utilized in a polymerization of the substituted anilines is a sulfo acid monomer (or polymer thereof) which may contain at least one sulfonic or sulfinic acid. Mixtures of sulfo acid monomers may be used. Acidic polymers prepared from sulfo acid monomers are preferred in the polymerization process of the present invention since the polymers contain little or no olefinic unsaturation. Specific examples of useful sulfo acid monomers (and polymers thereof) include vinyl sulfonic acid, ethane sulfonic acid, vinyl naphthalene sulfonic acid, vinyl benzene sulfonic acid, vinyl anthracene sulfonic acid, vinyl toluene sulfonic acid, methallyl sulfonic acid, 2-methyl-2-propene-1-sulfonic acid and acrylamidohydrocarbyl sulfonic acid.

A particularly useful acrylamidohydrocarbyl sulfo monomer is 2-acrylamido-2-methylpropane sulfonic acid. This compound is available from The Lubrizol Corporation, Wickliffe, Ohio, U.S.A., under the trademark AMPS® Monomer. Other useful acrylamidohydrocarbyl sulfo monomers include 2-acrylamidoethane sulfonic acid, 2-acrylamidopropane sulfonic acid, 3-methylacrylamidopropane sulfonic acid, and 1,1-bis(acrylamido)-2-methylpropane-2-sulfonic acid.

In one embodiment, the organic acid used in the polymerization reaction may be (a) a sulfo acid monomer represented by the formula $$(R_1)_2C{=}C(R_1)Q_aZ_b \qquad \text{(III)}$$

wherein each $R_1$ is independently hydrogen or a hydrocarbyl group; a is 0 or 1; b is 1 or 2, provided that when a is 0, then b is 1;

Q is a divalent or trivalent hydrocarbyl group or $C(X)NR_2Q'$;

each $R_2$ is independently hydrogen or a hydrocarbyl group;

Q' is a divalent or trivalent hydrocarbyl group;

X is oxygen or sulfur; and

Z is $S(O)OH$, or $S(O)_2OH$; or (b) a polymer of at least one of said monomers.

In Formula III, $R_1$ and $R_2$ are each independently hydrogen or hydrocarbyl. In a preferred embodiment, $R_1$ and $R_2$ are each independently hydrogen or an alkyl group having from 1 to 12 carbon atoms, preferably to about 6, more preferably to about 4. In a preferred embodiment, $R_1$ and $R_2$ are each independently hydrogen or methyl, preferably hydrogen.

Q is a divalent or trivalent hydrocarbyl group or $C(X)NR_2Q'$. Q' is a divalent or trivalent hydrocarbyl group. The divalent or trivalent hydrocarbyl groups Q and Q' include alkanediyl (alkylene), alkanetriyl, arenylene (arylene) and arenetriyl groups. Preferably, Q is an alkylene group, an arylene group or $C(H)(NR_2)Q'$. The hydrocarbyl groups each independently contain from 1, preferably from about 3 to about 18 carbon atoms, preferably up to about 12, more preferably to about 6, except when Q or Q' are aromatic where they contain from 6 to about 18 carbon atoms, preferably 6 to about 12. Examples of di- or trivalent hydrocarbyl groups include di- or trivalent methyl, ethyl, propyl, butyl, cyclopentyl, cyclohexyl, hexyl, octyl, 2-ethylhexyl, decyl, benzyl, tolyl, naphthyl, dimethylethyl, diethylethyl, and butylpropylethyl groups, preferably a dimethylethyl group.

In one embodiment, Q is $C(X)NR_2Q'$ and Q' is an alkylene having from about 4 to about 8 carbon atoms, such as dimethylethylene.

In another embodiment, the acid is (b) a polymer derived from at least one sulfo acid monomer represented by Formula III.

The polymers derived from the sulfo acid monomers generally are characterized as having sulfonic or sulfinic acid moieties extending from the backbone of the polymer. The polymers may also be derived from two or more different sulfo-acid moieties. Thus, the polymers may be copolymers or terpolymers of two or more of said sulfo acid monomers. In such instances one of the sulfo acid monomers may be a salt such as an alkali metal salt of the sulfo acid monomers. An example of a useful copolymer is the copolymer obtained from a mixture of 20 parts of AMPS monomer and one part of the sodium salt of 2-methyl-2-propene-1-sulfonic acid.

In another embodiment, the copolymers and terpolymers are prepared from (i) at least one sulfo acid monomer of Formula (III) and (ii) one or more comonomers selected from the group consisting of acrylic compounds; maleic acids, anhydrides or salts; vinyl lactams; vinyl pyrrolidones and fumaric acids or salts. The comonomer is preferably water soluble. Acrylic compounds include acrylamides, acrylonitriles, acrylic acids, esters or salts, methacrylic acids, esters or salts, and the like. Specific examples of these compounds include acrylamide, methacrylamide, methylenebis(acrylamide), hydroxymethylacrylamide, acrylic acid, methacrylic acid, methylacrylate, ethylacrylate, butylacrylate, 2-ethylhexylacrylate, hydroxyethylacrylate, hydroxybutylacrylate, methylacrylate, ethylacrylate, butylmethylacrylate, hydroxypropylmethacrylate, crotonic acid, methyl crotonate, butyl crotonate, hydroxyethyl crotonate. Alkali or alkaline earth metal (preferably sodium, potassium, calcium or magnesium) salts of acrylic, methacrylic or crotonic acids may also be used. Substituted and unsubstituted vinyl pyrrolidones and vinyl lactams, such as vinyl caprolactam, are useful as comonomers. Examples of useful maleic comonomers include alkali or alkaline earth metal salts of maleic acid (preferably sodium salts), $C_{1-6}$ alkyl esters (preferably methyl, ethyl or butyl), or ester-salts formed from $C_{1-6}$ alkyl esters and alkali or alkaline earth metals. Preferably, the monomers include acrylic or methacrylic acids, esters or salts. The comonomer is generally present in an amount from about 1%, more often from about 25% to about 75%. In one embodiment, about equal parts of the sulfo acid monomer and the comonomer are polymerized, more preferably about 50% by weight of the sulfo monomer or the comonomer.

The polymers are formed by polymerization of the sulfo monomers using conventional vinyl polymerization techniques. For solution polymerization, water is the preferred solvent for the preparation of the polymers of the present invention. Dimethylformamide is also suitable in many cases. Initiators used in the polymerization process are known to those in the art and include ammonium persulfate, hydrogen peroxide, redox initiators and organic soluble initiators such as azo-bis-isobutyronitrile.

The polymers may also be prepared in a high energy mechanical mixing means, such as an extruder or ball mill. The process using a high energy mechanical mixing means is described in U.S. Pat. No. 4,812,544 issued to Sopko et al. The process described therein is hereby incorporated by reference for its disclosure to making of polymers and copolymers with high energy mechanical mixing.

The sulfo polymers used in the present invention generally have a viscosity average molecular weight to about 9,000,000, preferably to about 1,000,000. The polymers generally have viscosity average molecular weight of at least about 5,000, preferably at least about 10,000. In one preferred embodiment, the sulfo polymers have a viscosity average molecular weight of about 10,000 to about 20,000.

The following examples A–C illustrate the preparation of sulfo acid polymers (or salts thereof) useful in the present invention. Unless otherwise indicated in the examples, and elsewhere in the specification and claims, temperature are in degrees Celsius, parts are parts by weight, and pressure is at or near atmospheric pressure.

EXAMPLE A

A monomer solution is prepared by mixing 43 parts (0.44 mole) of maleic anhydride with 666.5 parts (0.44 mole) of a 15% by weight solution of sodium 2-acrylamido-2-methylpropane sulfonate in dimethylformamide. The above monomer solution is added to a reaction vessel and heated to 60° C. under nitrogen. The reaction temperature is maintained at 60°–63° C. for 45 minutes where 0.6 part (0.004 mole) of azobis(isobutyronitrile) dissolved in 2.6 parts dimethylformamide is added to the reaction vessel. The reaction temperature is maintained at 60° C. for 19 hours. The reaction mixture is stripped to 80° C. and 10 millimeters of mercury to yield a clear viscous liquid. The product has an inherent viscosity of 0.039 $dLg^{-1}$ (0.25 part polymer in 100 parts 0.5 normal aqueous sodium chloride at 30° C.).

EXAMPLE B

A reaction vessel is charged with 67.7 parts (0.94 mole) of acrylic acid and 651 parts of dimethylformamide. Anhydrous sodium carbonate (49.8 parts, 0.47 mole) is added to the flask at 27° C. The slurry is stirred for 36 minutes at 25° C. The reaction temperature is increased to 40° C. and the mixture is stirred for three hours. A solution of 67.5 parts (0.69 mole) of maleic anhydride, 50 parts (0.065 mole) of a 30% solution of sodium 2-acrylamido-2-methylpropane sulfonate in dimethylformamide, and 75 parts dimethylformamide is added to the reaction vessel at 27° C. The reaction mixture is heated to 35° C. for 20 minutes. A solution of 0.5 parts of azobis(isobutyronitrile) in 3 parts dimethylformamide is added to the reaction vessel at 45° C. The reaction temperature increases exothermically to 70° C. over 20 minutes. The reaction temperature is maintained between 60°–63° C. for two hours. The reaction mixture is filtered and the filtrate is stripped at 80° C. and 10 millimeters of mercury. The residue has an inherent viscosity of 0.12 $dLg^{-1}$ (0.1077 part product in 100 parts 0.5 normal aqueous sodium chloride solution at 30° C.).

EXAMPLE C

A monomer solution is prepared by adding 414.4 parts (2 moles) of 2-acrylamido-2-methyl propane sulfonic acid and 15.8 (0.1 mole) parts of 2-methyl-2-propene-1-sulfonic acid, sodium salt to 990 parts of distilled water. The mixture is heated and purged with nitrogen to a temperature of about 60° C. whereupon the mixture of 10 parts of water and one part of 2,2′-azobis(2-amidinopropane) dihydrochloride is added. An exothermic polymerization reaction occurs, and the temperature reaches about 84° C. in about 10 minutes. The reaction mixture then cools to about 60° C. and stirring is continued for about 3 hours while maintaining the temperature at about 60° C. The mixture is then cooled and allowed to stand overnight. A pale-yellow liquid of the desired polymer acid is obtained having an acid neutralization number (to phenolphthalein) of 78.0 (theory, 78.4).

In one embodiment of the present invention, the poly(substituted aniline) acid salts are prepared by adding an aqueous solution of the oxidizing agent to an aqueous mixture of substituted aniline and optionally any of the comonomers mentioned above, and acid while maintaining the temperature of the reaction mixture below about 50° C. In a preferred embodiment, the temperature of the reaction is maintained below about 10° C., generally from about 0° to about 10° C. The polymerization reaction is generally completed in about 3 to 10 hours, although the reaction mixture is generally stirred for periods of up to 24 hours at room temperature after the initial reaction period. The poly(substituted aniline) acid salts obtained in this manner generally are washed with water or slurried in water and/or an alcohol such as methanol for periods of up to 24 or even 48 hours and thereafter dried.

The polymerization of mixtures of substituted aniline and other comonomers in accordance with the process of the present invention can be conducted in the presence of solid substrates which are generally inert materials such as silica, mica, talc, glass, alumina, zeolites, cellulose, organic polymers, etc. In these embodiments, the poly(substituted aniline) generally is deposited on the substrate as a coating which may also penetrate into the open pores in the substrate. The substrates may be of any size and shape including irregular as well as regular shapes such as rods, spheres, etc.

In one particular embodiment of the present invention, the polymerization of substituted aniline is conducted in the presence of a zeolite (e.g., Zeolite LZ-Y52, from the Linde division of Union Carbide and identified as $Na_{56}Al_{56}$, $Si_{136}O_{384}$) and cupric nitrate. The cupric nitrate is dissolved in water and the zeolite is added with stirring whereupon an exchange occurs. It is believed that copper atoms exchange for at least some of the sodium atoms in the zeolite. In the gas phase reaction with aniline, cupric ion is reduced to cuprous ion with the generation of an acid function, resulting in the formation of polyaniline within the detailed structure and as a coating on the zeolite particles.

In another embodiment of the present invention, the polymerization of the substituted anilines in the presence of acid and an oxidizing agent is conducted in the presence of cellulose particles which may be either in the form of fibers, spheres, rods, etc. The deposition of the poly(substituted aniline) acid salts on and in the cellulose results in particles useful as the dispersed phase which may be designed to provide various and desired aspect ratios which can be utilized to control the shape of the dipole and separation of charge of the dispersed phase in the ER fluids. Examples of useful cellulose particles are CF1 and CF11 available from Whatman Specialty Products Division of Whatman Paper Limited, Maidstone, Kent, Me. 142LE. CF1 is identified as a long fibrous cellulose with a fiber length 100–400 μm and a mean diameter of 20–25 μm. CF11 is a medium fibrous cellulose with fiber length range of from 50–250 μm and a mean diameter of 20–25 μm.

Although the precise nature or structure of the poly(-substituted aniline) acid salts has not been determined, it is believed that under the oxidizing conditions used in the above-described reactions, the polymerization reaction results in a poly(substituted aniline) characterized principally by the emeraldine structure. Some nigraniline structure may be present.

The acid salts of poly(substituted aniline) prepared in accordance with the above procedures generally are treated with a base to remove protons from the acid salt, and reduce the conductivity of the polyaniline salt. The protons are those derived from the acid used in the polymerization reaction. Various basic materials may be utilized to deprotonate the acid salt. Generally, the base is ammonium hydroxide or a metal oxide, hydroxide, alkoxide or carbonate. The metal may be an alkali metal such as sodium or potassium or an alkaline earth metal such as barium, calcium or magnesium. When the base is ammonium hydroxide or alkali metal hydroxide or carbonate, aqueous solutions of the hydroxide and carbonate are utilized for reaction with the acid salt of polyaniline. When metal alkoxides are utilized for this purpose, the solvent or diluent is generally an alcohol. Examples of alkoxides which may be utilized include sodium methoxide, potassium ethoxide, sodium ethoxide, sodium propoxide, etc. Examples of alcohol include methanol, ethanol, propanol, etc.

In one embodiment, the metal carbonate used as the base may be an overbased or gelled overbased metal salt. Overbased metal salts are characterized by metal content in excess of that which would be present according to stoichiometry of metal in the particular organic compound reacted with the metal. Typically, a metal salt is reacted with an acidic organic compound such as a carboxylic, sulfonic, phosphorus, phenol or mixtures thereof. An excess of metal is incorporated into the metal salt using an acidic material, typically carbon dioxide. Gelled overbased metal salts are prepared by treating an overbased metal salt with a conversion agent, usually an active hydrogen-containing compound. Conversion agents include lower aliphatic carboxylic acids or anhydrides, water, aliphatic alcohols, cycloaliphatic alcohols, aryl aliphatic alcohols, phenols, ketones, aldehydes, amines and the like. The overbased and gelled overbased metal salts are known and described in U.S. Pat. No. 3,492,231 issued to McMillen which is hereby incorporated by reference for its disclosure to overbased and gelled overbased metal salts and processes for making the same.

The poly(substituted aniline) acid salt obtained as described above may be treated with an amount of a base for a period of time which is sufficient to remove the desired amount of protons from the acid salt. In one embodiment the acid salt may be treated with up to about 5 moles, more often about 2 moles, of base per mole of acid salt. For the purposes of this invention the term "acidic protons" refers to protons ($H^+$) which are attached to the nitrogen atom in the poly(substituted aniline). The protons may also be referred to as labile protons: The removal of protons (deprotonation) is required when the polyaniline acid salts prepared in accordance with the above procedures are too conductive to provide ER fluids having the desired characteristics. Thus, the degree of deprotonation will depend upon the conductivity of the poly(substituted aniline) acid salt as formed and the ability of the poly(substituted aniline) acid salt to perform in a particular ER fluid. The extent of the deprotonation desired can be readily determined by one skilled in the art by observing the effect of the deprotonated poly(substituted aniline) acid salt when the salt is utilized as the dispersed phase in an ER fluid. It is generally believed that although it is desired to utilize conductive polymers as the dispersed phase in an ER fluid, the conductive composition is preferably a semi-conductor exhibiting minimal conductivity.

In one preferred embodiment, the poly(substituted aniline) acid salts prepared in accordance with the process of the present invention are treated with an amount of the base for a period of time which is sufficient to remove substantially all of the protons derived from the acid. For example, if the acid utilized in the polymerization is hydrochloric acid, the poly(substituted aniline) acid salt is treated with the base in an amount which is sufficient to reduce the chloride content of the acid salt to as low as from 0 to 0.2%.

It has been observed that the electronic conductivity characteristics of the poly(substituted aniline) salts may be regulated and controlled more precisely by initially removing substantially all of the protons from the poly(substituted aniline) acid salt obtained from the polymerization reaction, and thereafter treating the deprotonated poly(substituted aniline) compound with an acid, a halogen, sulfur, sulfur halide, sulfur trioxide, or a hydrocarbyl halide to form a poly(substituted aniline) compound having a desired conductivity. The level of conductivity obtained can be controlled by the selection of the type and amount of these compounds used to treat the poly(substituted aniline) which is substantially free of acidic protons. The same procedure can also be used to increase the conductivity of poly(substituted aniline) acid salts which have not been reacted with a base to the extent necessary to remove substantially all of the acidic protons. This treatment of the poly(substituted aniline) with an acid, halogen, sulfur, sulfur halide, sulfur trioxide, or hydrocarbyl halide to form a polyaniline compound having a desired conductivity generally is known in the art as "doping".

Any of the acidic compounds described above as being useful reagents in the polymerization of the substituted aniline may be utilized as dopants. Thus, the acids may be any of the mineral acids or organic acids described above. In addition, the acid may be the Lewis acid such as aluminum chloride, ferric chloride, stannous chloride, boron trifluoride, zinc chloride, gallium chloride, etc.

The conductivity of the poly(substituted aniline) can be increased also by treatment with a halogen such as bromine or iodine, or with a hydrocarbyl halide such as methyl iodide, methyl chloride, methyl bromide, ethyl iodide, etc., or with sulfur or a sulfur halide such as sulfur chlorides or sulfur bromides.

The poly(substituted aniline) compounds which are substantially free of acidic protons are treated in accordance with the present invention with an amount of the above compounds which is sufficient to provide a desired conductivity as determined by the anticipated utility of the treated poly(substituted aniline). The desired conductivity of the treated product will depend in part upon the other components of the electrotheological fluid and the characteristics desired of the ER fluid. The characteristics, including the conductivity and rheological properties of the ER fluid may be varied in part by variations in the conductivity of the dispersed particulate phase, the presence of non-conductive particles in the ER fluid, and the amount of the dispersed particulate phase in the ER fluid. In one embodiment, the poly(substituted aniline) compounds which have been deprotonated are treated with hydrochloric acid in sufficient quantity to form a product containing up to about 5% chloride, more often up to about 1%.

The conductive polymers useful as the dispersed particulate phase in the ER fluids of the present invention may also be derivatives of polypyrroles, polyvinylpyridines, polyvinylpyrrolidones, polyimidazoles, polyphenathiazines, polyphenylene oxides, polyphenylene sulfide, or mixtures thereof wherein the derivatives are obtained by treating these polymers with an amount of an acid, halogen, sulfur, sulfur halide, sulfur oxide or a hydrocarbyl halide as described above with respect to the poly(substituted anilines). Treatment of the polymers in this manner results in the formation of derivative compounds characterized by an increased electronic conductivity. Thus, the conductivity of the derivatives can be controlled by such treatment. In this regard, the discussion above with regard to the treatment of poly(substituted anilines), with such materials including the types of materials and conditions of the treatment are applicable equally to the treatment of these additional polymers.

The following examples illustrate the preparation of various conductive polymers useful as the conductive dispersed particulate phase in the non-aqueous ER fluids of the present invention.

EXAMPLE 1

To a 5-liter flask there are added 214 parts (2 moles) of o-toluidine and 600 parts of concentrated hydrochloric acid (7.2 moles) in 1400 parts of water. The mixture is cooled to 6° C. and a solution of 0.28 part (0.001 mole) ferrous sulfate heptahydrate in 20 parts of water is added followed by a solution of 912 parts (4 moles) of ammonium persulfate in 200 parts of hydrochloric acid dissolved in 1800 parts of water precooled to 5° C. As this solution is added, the reaction temperature rises to about 22° C. The reaction mixture is maintained at about 20° C. by external cooling, and the persulfate addition is completed in about 3.5 hours. Stirring is continued overnight and the reaction mixture then is filtered. The residue is slurried with 2500 parts of water, stirred for about 5 hours and filtered. The residue thus obtained is slurried with 200 parts (3 moles) of ammonium hydroxide and 2000 parts of distilled water and stirred overnight. The mixture is again filtered, and the residue thus obtained is slurried with 2500 parts of water and stirred overnight. The mixture is filtered, and a black residue is obtained which is dried in a steam chest for about two days and finally in a vacuum oven at 140° C. for 24 hours. The solid obtained in this manner contains 8.55% nitrogen, 0.11% sulfur and 2.85% chlorine.

EXAMPLE 2

A 5-liter reaction flask is charged with 89 parts (0.83 mole) of ortho-toluidine, 570 parts (0.79 mole) of the sulfo acid polymer of Example C and 1000 parts of distilled water. The mixture is cooled to 5° C. by external cooling and a solution of 189.2 parts (0.83 mole) of ammonium persulfate in 500 parts of distilled water (precooled to 5° C.) is added to the reaction flask over a period of about 5 hours. During the addition, the temperature of the reaction mixture is maintained at between 5° and 8° C. The mixture is stirred overnight and filtered. A green residue is obtained and is slurried with 2500 parts of water with stirring for about 4 hours, and the slurry is filtered. The residue is dried in a forced air oven at 105° C. for 48 hours and in a vacuum oven at 140° C. for 24 hours. A black powder is obtained which contains 9.86% nitrogen and 6.21% sulfur.

EXAMPLE 3

A 5-liter reaction flask is charged with 1800 parts of water and 166 parts (2 moles) of hydrochloric acid, and 214 parts (2 moles) of o-toluidine are added over 5 minutes. The mixture is cooled to 5° C. and a solution (precooled to 5° C.) of 501.6 parts (2.2 moles) of ammonium persulfate in 1400 parts of water is added over a period of about 6.5 hours while maintaining the temperature at about 5°–6° C. The mixture is stirred overnight as the temperature of the mixture approaches ambient temperature. The mixture is filtered, and the residue is rinsed with 3000 parts of water. The residue thus obtained is slurried with 2000 parts of water, stirred for 3 hours, filtered and washed with 2000 parts of water. The residue is slurried with 2500 parts of water, stirred for about 17 hours and again filtered. The residue is slurried with 2500 parts of water, stirred for 4 hours and filtered.

The residue thus obtained is slurried with 198 parts (3 moles) of aqueous ammonium hydroxide and 2300 parts of water, stirred for about 19 hours and filtered. The residue is rinsed with 1000 parts of water, slurried with 2500 parts of water, stirred for 3.5 hours and filtered. The residue is rinsed with 1000 parts of water and transferred to a glass dish. The residue is dried in a forced air oven at 106° C. for 48 hours, ball-milled for 24 hours and dried in a vacuum oven at 150° C. for 24 hours. The black powder obtained in this matter contains 11.76% nitrogen and 0.99% sulfur, but no detectable chlorine.

EXAMPLE 4

A 5-liter reaction flask is charged with 166 parts (2 moles) of concentrated hydrochloric acid and 1800 parts of distilled water. At a temperature of about 23° C., 214 parts (2 moles) of m-toluidine are added as the temperature rises to about 30° C. The mixture is cooled to 6° C. by external cooling, and a solution of 456 parts (2 moles) of ammonium persulfate in 1400 parts of distilled water (precooled to 5° C.) is added over a period of about 6 hours. During the addition, the temperature is maintained at between 5°–8° C. by external cooling. The mixture is stirred overnight and filtered. The residue is slurried with 2500 parts of water and stirred for 24 hours. This mixture is filtered and the residue thus obtained is washed with 1000 parts of water and then slurried with 1000 parts of water with stirring for about 3.5 hours. The slurry is filtered and the residue is mixed with 198 parts (3 moles) of ammonium hydroxide in 2300 parts of water with stirring for a period of about 17 hours. This mixture is filtered and the residue obtained is slurried with 2500 parts of water with stirring for about 4 hours. The mixture is filtered and the residue is slurried with 2500 parts of water with stirring for 1.5 hours. A black residue is obtained when the mixture is filtered, and the residue is dried in a forced air oven at 110° C. for about 3 days and then in a vacuum oven at 140° C. for 24 hours. The black powder obtained in this manner contains 12.30% nitrogen, 0.46% chlorine and 0.02% sulfur.

EXAMPLE 5

A 2-liter flask is charged with 100 parts of 0.12M hydrochloric acid (0.012 mole) and 900 parts of distilled water. To this mixture there is then added 107 parts (1 mole) of the product of Example 4. The mixture is stirred for about 24 hours and filtered. The black residue is obtained which is dried in a forced air oven at 100° C. for 24 hours and in a vacuum oven at 150° C. for 24 hours. The black powder obtained in this manner contains 10.09% nitrogen, 0.27% chlorine and 0.007% sulfur.

EXAMPLE 6

A 5-liter flask is charged with 255.2 parts (2 moles) of o-chloroaniline, 166 parts (2 moles) of concentrated hydrochloric acid and 1200 parts of water to form a slurry. A solution of 456 parts (2 moles) of ammonium persulfate in 1400 parts of water is added to the flask dropwise at a temperature of 3°–5° C. over 6 hours. The mixture is stirred overnight and filtered. The residue is slurried in 3000 parts of distilled water and stirred overnight. The solid is recovered by filtration and slurried in 3000 parts of methanol with stirring overnight. The slurry is then filtered, and the residue slurried in 2500 parts of distilled water and 132 parts (2 moles) of ammonium hydroxide. This mixture is stirred for 48 hours and filtered. The filtrate is again slurried in 2500 parts of distilled water and 132 parts (2 moles) of ammonium hydroxide for 48 hours. The solid is recovered by filtration and slurried in 2500 parts of distilled water overnight and filtered. The residue is dried in a steam oven, and thereafter dried in a vacuum oven at 150° C. The solid obtained in this manner contains 14.76% nitrogen but no detectable sulfur.

EXAMPLE 7

A 5-liter flask is charged with 214 parts (2 moles) of N-methyl aniline, 166 parts (2 moles) of concentrated hydrochloric acid and 1200 parts of water, and this mixture is cooled to 5° C. A solution of 456 parts (2 moles) of ammonium persulfate in 1400 parts of distilled water is prepared and added at a temperature of 3°–8° C. The reaction mixture is stirred overnight and filtered. The residue is slurried in 3000 parts of distilled water and stirred overnight. The solid is recovered by filtration and slurried in 3000 parts of methanol with stirring overnight. The slurry is then filtered, and the residue slurried in 2500 parts of distilled water and 132 parts (2 moles) of ammonium hydroxide. This mixture is stirred for 48 hours and filtered. The filtrate is again slurried in 2500 parts of distilled water and 132 parts (2 moles) of ammonium hydroxide for 48 hours. The solid is recovered by filtration and slurried in 2500 parts of distilled water overnight and filtered. The residue is dried in a steam oven, and thereafter dried in a vacuum oven at 150° C. The solid obtained in this manner contains 14.13% nitrogen and 0.04% sulfur.

EXAMPLE 8

A 12-liter flask is charged with 137.1 parts (1 mole) of anthranilic acid and 6000 parts of distilled water followed by the addition of 70 parts (0.14 mole) of 2M hydrochloric acid and 1500 parts of denatured ethanol. The mixture is cooled in an ice bath to about 6° C. whereupon a solution of 228 parts (1 mole) of ammonium persulfate and 1000 parts of water is added dropwise to the stirred mixture. The solution is added at a rate that maintains the reaction temperature at 10° C. or below. Twenty minutes after the addition of the persulfate solution has begun, 500 parts (1 mole) of 2M hydrochloric acid are added to the reaction flask, and the remaining portion of the oxidant solution is added over a period of 2 hours. The mixture is stirred for 22 hours and allowed to stand for 10 days. The reaction mixture is filtered, and the black residue is slurried with 1000 parts of distilled water for one week and filtered. The black residue is placed in a dish and dried in a steam chest for 2 days. The solid obtained in this manner contains 7.11% nitrogen and 0.063% chlorine.

EXAMPLE 9

A reaction flask is charged with 23.5 parts (0.25 mole) of aniline, 27.0 parts (0.25 mole) of o-toluidine, 31.1 parts (0.25 mole) of o-anisidine, 17 parts (0.25 mole) of pyrrole and 800 parts of distilled water. Hydrochloric acid (83 parts, 1 mole) is added to the mixture over a period of 15 minutes with stirring. The temperature of the mixture reaches 30° C. from an initial temperature of 25° C. After standing overnight, the mixture is cooled to 5° C. by external cooling, and a solution of 228 parts (1 mole) of ammonium persulfate in 800 parts of water is added dropwise over a period 4 hours. The temperature of the reaction mixture is maintained between 0° and 10° C. during the addition, and the mixture is stirred overnight. The reaction mixture is filtered, and the black residue is washed with 1000 parts of distilled water. The filtrate is placed in a beaker, and 50 parts of ammonium persulfate is added with stirring. The stirring is continued for 24 hours and the mixture is filtered. The combined black residues are slurried with 2000 parts of distilled water, stirred for 24 hours and filtered. A black residue is obtained which is slurried with 198 parts (3 moles) of aqueous ammonium hydroxide and 2 liters of water (pH=10.5), and the mixture is stirred for 24 hours. The mixture is filtered and a black residue is obtained which is slurried with 2000 parts of water followed by stirring for 6 hours and filtration. This process is repeated twice. The black residue thus obtained is dried in a forced air oven at 100° C. for 24 hours followed by drying in a vacuum oven at 110° C. for 24 hours. A black solid is obtained which contains 13.3% nitrogen and 0.4% sulfur.

EXAMPLE 10

Ferric chloride (373 parts, 2.3 moles) is dissolved in 3000 parts of distilled water in a 5-liter flask. Pyrrole (67.09 parts, 1 mole) is added dropwise to the flask over a period of about 45 minutes as the temperature of the mixture increases a maximum of 3° C. The mixture is stirred at room temperature for one day, allowed to stand for two days, filtered, and the residue is washed with distilled water until the filtrate is colorless. The residue is dried overnight in a steam oven and dried in a vacuum oven at 120°–125° C. The polypyrrole salt prepared in this manner contains 16.3% nitrogen and 10.59% chlorine.

EXAMPLE 11

A 3-liter flask is charged with 66 parts (1 mole) of aqueous ammonium hydroxide and 1940 parts of distilled water. The polypyrrole salt of Example 10 (100 parts) is added and the mixture is stirred at room temperature for one day. The reaction mixture is filtered, and the residue is slurried with 2000 parts of distilled water overnight. The slurry is filtered, and the residue is dried in a vacuum oven at 150° C. The powder obtained in this matter contains 19.0% nitrogen and 0.97% chlorine.

EXAMPLE 12

A 5-liter flask is charged with 491.7 parts (1.76 moles) of ferric chloride hexahydrate and 3700 parts of water. A solution of 8 parts (0.18 mole) of polyvinyl alcohol (Mw 25000) in 100 parts of water is prepared by heating to 75° C. with stirring for about 15 minutes. This solution also is added to the 5-liter flask. Pyrrole (50.8 parts, 0.75 mole) is added to the reaction flask over a period of about 15 minutes, and the black reaction mixture is stirred overnight. The mixture is then filtered, and the black residue thus obtained is slurried with 2500 parts of water, stirred for one hour and filtered. The residue is again slurried with 2000 parts of water, stirred for 3.5 hours and filtered. The residue is dried in a forced air oven at 55° C. for 6 hours and in a vacuum oven at 110° C. for 48 hours. A black solid is obtained which contains 15.4% nitrogen and 9.08% chlorine.

EXAMPLE 13

A polypyrrole lauryl sulfate is prepared in accordance with the general procedure described in U.K. Patent 2,184,738. In this procedure, 1200 grams (17.89 moles) of pyrrole, 1200 grams (4.16 moles) of sodium lauryl sulfate, 600 grams of polyethyleneoxide (molecular weight=20,000) and 15 gallons of water are mixed and electropolymerized using a 17 inch×36 inch×0.05 inch 10/10 steel anode cleaned with a fine wire brush. The anode is bussed along the 36 inch top dimension with two 1.5×36×0.1 inch copper strips using 5 bolts passing through the anode plate. The inner 3 bolts serve as the anode electrical connections. The electropolymerization is conducted at 100 amps for 120 minutes. The power is removed and the mixture is cooled to ambient temperature, washed with water and filtered. The residue is washed 3 times with water, ground in a Waring blender with water and filtered. The residue is washed with water and then methanol. The powder is vacuum dried at 75° C. overnight. The dry powder obtained in this manner contains 62.31% carbon, 10.77% nitrogen, 5.33% sulfur and 0.010% sodium.

EXAMPLE 14

A 2-liter flask is charged with 196.7 parts (0.3 mole) of the polypyrrole lauryl sulfate prepared in Example 13, and 900 parts of methanol are added to form a slurry. A solution of 20 parts of potassium hydroxide (0.357 mole) in 300 parts of water is prepared and added to the flask over a period of two hours with stirring. The mixture is stirred for several hours at room temperature and filtered. The residue is slurried and washed with 1000 parts of methanol, 1000 parts of aqueous methanol (50/50) and finally, two times with 1000 parts of methanol. The slurry is filtered, and the residue is air dried and dried in a steam oven. The product obtained in this manner contains 1.88% sulfur.

EXAMPLE 15

A 1-liter reaction flask is charged with 103.6 parts (0.5 mole) of AMPS monomer and 500 parts of distilled water. The mixture is purged with air at a temperature of about 23° C., and 47.7 parts (0.45 mole) of 4-vinyl pyridine are added dropwise over a period of 0.5 hour with stirring. The mixture is stirred an additional one hour whereupon the mixture is heated with a nitrogen purge to a temperature of 57° C. and a solution of 0.5 part of 2,2'-azobis(2-amidinopropane) dihydrochloride in two parts of water is added. The mixture is stirred overnight while maintaining the temperature at about 57° C. The reaction mixture is transferred into an aluminum pan and dried in a steam chest for 7 days. The product finally is dried in a vacuum oven at 120° C. for 24 hours. A slightly pink solid is obtained which contains 8.79% nitrogen and 10.30% sulfur.

EXAMPLE 16

A 1-liter reaction flask is charged with 72 parts (1 mole) of acrylic acid and 700 parts of distilled water. To this mixture is added 100.7 parts (0.95 mole) of 4-vinylpyridine dropwise over 15 minutes. During this addition, the temperature rises from about 23° C. to about 36° C. When the addition of the 4vinylpyridine is completed, the reaction mixture is heated and purged with nitrogen to a temperature of 60° C. whereupon a solution of one part of 2,2'-azobis(2-amidinopropane) dihydrochloride in 5 grams of water is added. The mixture is heated at about 60° C. with stirring for about two days, and the mixture is transferred to a pyrex glass dish and dried in a steam chest for 18 days and in a vacuum oven at 125° C. for 40 hours. A brown solid is obtained which contains 8.31% nitrogen.

EXAMPLE 17

A 1-liter reaction flask is charged with 55 parts (0.5 mole) of 4-vinylpyridine, 200 parts of distilled water and 200 parts of methanol. The mixture is stirred purging with nitrogen, is heated. At a temperature of 59° C., a solution of 0.2 part of 2,2'-azobis(2-amidinopropane) dihydrochloride in two parts of water is added. Stirring is continued for about 36 hours at a temperature of about 60° C. At this time, the mixture is cooled and allowed to stand overnight. A mixture of 62.4 parts (0.25 mole) of cuprous sulfate pentahydrate in 200 parts of water and 200 parts of methanol is prepared and added to the reaction flask. Stirring is continued for two days. The reaction mixture is transferred to a glass dish and dried in a steam chest for 8 days followed by drying in a vacuum oven at 125° C. for 24 hours. A brown solid is obtained which contains 7.33% nitrogen and 15.2% copper.

EXAMPLE 18

A 1-liter reaction flask is charged with 22.4 parts (0.213 mole) of poly(2-vinylpyridine) from Aldrich Chemical and 250 parts of water. A solution of 26.6 parts (0.106 mole) of cuprous sulfate pentahydrate in 150 parts of water is added over a period of five minutes. The mixture is stirred overnight at which time the reaction mixture is filtered. A green filtrate is obtained and transferred to a pyrex glass dish. The green filtrate is dried in a steam chest for 5 days and finally in a vacuum oven at 125° C. for 24 hours. A brown solid is obtained which contains 8.53% nitrogen and 9.2% copper.

EXAMPLE 19

Poly(2-vinylpyridine) (25 parts) from Polyscience is placed in a dish in a dessicator charged with iodine crystals. The mixture is allowed to equilibrate for 25 days with occasional mixing. The material turns brown. At the end of this period, there is a weight increase of about 7.3%.

EXAMPLE 20

A 2-liter reaction flask is charged with 108 parts (1 mole) of polyphenylene sulfide and 500 parts of hexane. At a temperature of about 23° C., sulfur trioxide (40 parts, 0.5 mole) and nitrogen are bubbled through the reaction mixture for about 3 hours and 45 minutes with stirring. The temperature of the mixture reaches 31° C. The mixture is then filtered, and the residue is rinsed with 500 grams of hexane. The residue is stirred with 1000 parts of water for 30 minutes and filtered. The residue thus obtained is washed with 500 parts of water and slurried with 1000 parts of water with stirring for about 1.5 hours. The mixture is filtered, and the residue is slurried with 1000 parts of water, stirred for two hours and filtered. A camel colored solid thus obtained is dried in a forced air oven at 100° C. for 24 hours and ball milled. The powder obtained in this manner contains 27.48% sulfur.

EXAMPLE 21

A 1-liter beaker is charged with 5 parts of sodium hydroxide and 600 parts of water. To this mixture there is added 50 parts of the product prepared in Example 20, and the mixture is stirred for about 5 hours and filtered. The residue is slurried with 600 parts of water, stirred for 30 minutes, and filtered. The residue thus obtained is again slurried with 600 parts of water, stirred for 30 minutes and filtered. The residue is dried in a steam chest for 24 hours, and the brown powder obtained in this manner contains 33.6% sulfur.

EXAMPLE 22

A 1-liter reaction flask is charged with 108 parts (1 mole) of polyphenylene sulfide and 400 parts of hexane. Fuming sulfuric acid (30% $SO_3$, 540 parts, 2 moles) is added over a period of 5.5 hours with stirring. The mixture was stirred an additional hour and allowed to stand for two days. The mixture is filtered, and the black residue thus obtained is digested with 3000 parts of water, stirred for one hour and filtered. The filtrate thus obtained is slurried with 3000 parts of water, stirred for 3 hours and filtered. This brown residue is slurried with 8000 parts of tap water, stirred for 2 hours and filtered. The residue is ball-milled for 48 hours and centrifuged. The brown residue thus obtained is taken up with a fresh supply of distilled water and centrifuged. This procedure is repeated five times. The brown residue thus obtained is dried in a forced air oven at 100° C. and ball milled. The black powder which is obtained in this manner is the desired product containing 26.2% sulfur.

EXAMPLE 23

Polyphenylene sulfide (30 parts) is placed in a shallow dish in a dessicator charged with an excess of iodine crystals and allowed to equilibrate for 7 days. At the end of this time, a weight increase of 0.5 part (1.5%) is obtained.

The ER fluids of the present invention are prepared by mixing the above-described conductive polymer compounds (as the dispersed phase) with the selected hydrophobic liquid phase. The polymers may be comminuted to certain particle sizes if desired. The electrorheological fluids of the present invention may contain from 5 to about 80% by weight of the polymer dispersed phase. More often, the ER fluids contain a minor amount (i.e., up to about 49%) of the dispersed phase. In one embodiment, the ER fluids of the present invention contain from about 5 to about 40% by weight of the polymer dispersed phase, and in another embodiment, the ER fluids will contain from about 20 to about 40% of the polymer compounds.

In accordance with certain embodiments of the present invention, electrorheological fluids are provided which are characterized as having a Winslow Number (Wn) in excess of 3000 at 20° C., and in other embodiments, the ER fluids are characterized as having Wn in excess of 100 at the maximum temperature of the intended application. This temperature may be 80° C., 100° C., or even 120° C.

Desirable and useful ER fluids are provided in accordance with the present invention which are essentially non-aqueous or essentially anhydrous. Small amounts (for example, less than about 1% based on the total weight of the fluid) of water may be present which may, in fact, be essentially impossible to remove, but such amounts do not hinder the performance of the ER fluids of the present invention.

In addition to the hydrophobic liquid phase and the dispersed particulate phase of conductive polymer, the ER fluids of the present invention may contain other components capable of imparting or improving desirable properties of the ER fluid. Examples of additional components which may be included in the ER fluids of the present invention include organic polar compounds, organic surfactants or dispersing agents, viscosity index improvers, etc. The amount of the above additional components included in the ER fluids of the present invention will be an amount sufficient to provide the fluids with the desired property and/or improvement. Generally, from about 0 to about 10% by weight, and more often from about 0 to about 5% by weight of one or more of the additional components can be included in the ER fluids of the present invention to provide desirable properties including viscosity and temperature stability. It is highly desirable, for example, that the particulate dispersed phase remain dispersed over extended periods of time such as during storage, or, if the particulate dispersed phase settles on storage, the phase can be readily redispersed in the hydrophobic liquid phase.

In one embodiment, it is desirable to include in the ER fluids of the present invention at least one organic polar compound. Examples of useful polar compounds include organic compounds such as amines, amides, nitriles, alcohols, polyhydroxy compounds, ketones and esters. Examples of amides include acetamide and N-methyl acetamide. Polyhydroxy compounds are useful in the ER fluids of the present invention, and examples of such polar compounds include ethylene glycol, diethylene glycol, propylene glycol, glycerol, pentaerythritol, etc.

The surfactants which can be utilized in the ER fluids of the present invention are useful for improving the dispersion of the solids throughout the vehicle and in maintaining the stability of the dispersions. Preferably, the surfactants are soluble in the hydrophobic liquid phase. The surfactants may be of the anionic, cationic or nonionic type although the nonionic type of surfactants generally are preferred. Examples of nonionic surfactants useful in the ER fluids of the present invention include fatty acids, partial or complete esters of polyhydric alcohols including fatty acid esters of ethylene glycol, glycerine, mannitol and sorbitol. Specific examples include sorbitan sesquioleate sorbitan monooleate, sorbitan monolaurate, glycerol monooleate, glycerol dioleate, mixtures of glycerol mono- and dioleate, polyoxyalkylene derivatives of sorbitan trioleate, etc.

In one embodiment, the surfactants are functionalized polysiloxanes including amino functional, hydroxy functional, mercapto functional, carboxy functional, acetoxy functional or alkoxy functional polysiloxanes which generally have a molecular weight above 800. The functional groups may be terminal, internal, or terminal and internal. The functional polysiloxane surfactants may be represented by the following formula

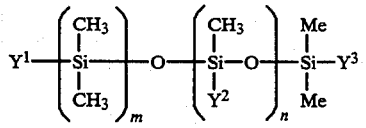

(IV)

wherein each of $Y^1$–$Y_3$ is independently $CH_3$ or a functional group selected from —R'N(R')H, —R'OH, —R'OR, —R'SH, —R'COOH wherein R' is a divalent group consisting of C, H and optionally O and/or N, R is hydrogen or an alkyl group containing 1 to about 8 carbon atoms, or $$-(CH_2CH_2O)_p-R^2 \text{ or } -(CH_2-CH(CH_3)O)_p-R^2$$

$R^2$ is H or a hydrocarbyl group, m is a number from about 10 to about 1000, n is a number from 0 to 10, and p is a number from 1 to about 50 provided that at least one of $Y^1$–$Y^3$ is not $CH_3$. In one embodiment, both $Y^1$ and $Y^3$ are functional groups and $Y^2$ is methyl. These silicones are referred to herein as terminally functionalized silicones. When $Y^1$ and $Y^3$ are methyl, and $Y^2$ is one of the functional groups reacted, the silicone is referred to as an internally functionalized silicone.

The divalent group R' may be an alkylene group, an oxy alkylene group or an amino alkylene group wherein the oxygen atom or the nitrogen atom, respectively, are attached to the silicon atom. The alkylene group may contain from 1 to about 3 or 4 carbon atoms, and specific examples include methylene, ethylene, n-propylene, i-propylene, etc. The hydrocarbyl group $R^2$ may be alkyl or aryl group. Generally, $R^2$ is a lower alkyl group such as methyl, ethyl, etc.

Specific examples of the functional groups $Y^1$–$Y^3$ which may be included in the siloxanes of Formula (II) include $-CH_2NH_2$, $-CH_2N(CH_3)H$, $-CH_2CH_2NH_2$, $-CH_2CH_2CH_2NH_2$, $-CH_2CH_2SH$, $-CH_2CH_2CH_2OH$, $-CH_2CH_2CH_2SH$, $-CH_2CH_2COOH$, $-CH_2CH_2CH_2COOH$, $-CH_2CH_2OCH_3$, $-OCH_2CH_2OH$, $-OCH_2CH_2NH_2$, $-CH_2O(CH_2CH_2O)_2H$, $-CH_2O(CH_2CH_2O)_2CH_3$, $-CH_2O(CH_2CH(CH_3)O)_2H$, $-CH_2O(CH_2CH(CH_3)O)_2CH_3$, etc.

Functionalized polysiloxanes which are useful as surfactants in the ER fluids of the present invention are available commercially from a variety of sources. For example, an internal carbinol functional silicone polymer is available from Genesee Polymers Corporation, Flint, Mich., under the trade designation EXP-69 Silicone Fluid. This fluid is reported to be characterized by the following formula

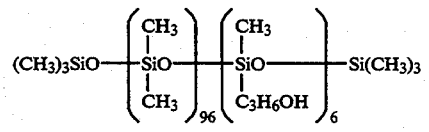

(IVA)

A mercapto modified silicone also is available from Genesee Polymers under the designation GP-72A. The following is given as a representative structure by the manufacturer.

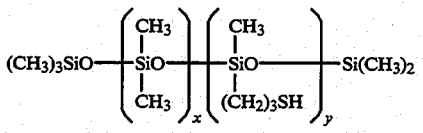

(IVB)

An example of a commercially available carboxy-terminated polysiloxane is PS573 from Petrarch Systems, Bristol, Pa. which may be characterized by Formula (IIC).

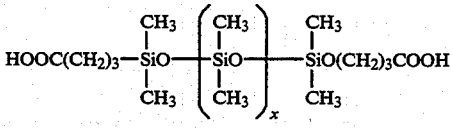

(IVC)

In some instances, it may be desirable to add materials capable of increasing and stabilizing the viscosity of the ER fluids when the fluid is not under the influence of an electrical field. Materials which have been described in the literature as viscosity modifying agents in lubricating oils may be used for this purpose in the fluids of the present invention. Viscosity modifying agents generally are polymeric materials characterized as being hydrocarbon-based polymers generally having a number average molecular weight of between about 25,000 and 500,000, more often between about 50,000 and 200,000. The viscosity modifiers may be included in the ER fluids of the present invention in amounts from about 0 to about 10% or more as required to modify the viscosity of the fluid as desired.

Polyisobutylenes (PIB), polymethacrylates (PMA), ethylene-propylene copolymers (OCP), esters of copolymers of styrene and maleic anhydride, hydrogenated polyalpha-olefins and hydrogenated styrene-conjugated diene copolymers are useful classes of commercially available viscosity modifiers.

Polymethacrylates (PMA) are prepared from mixtures of methacrylate monomers having different alkyl groups. Most PMA's are viscosity modifiers as well as pour point depressants. The alkyl groups may be either straight chain or branched chain groups containing from 1 to about 18 carbon atoms.

The ethylene-propylene copolymers, generally referred to as OCP can be prepared by copolymerizing ethylene and propylene, generally in a solvent, using known catalysts such as a Ziegler-Natta initiator. The ratio of ethylene to propylene in the polymer influences the oil-solubility, oil-thickening ability, low temperature viscosity and pour point depressant capability of the product. The common range of ethylene content is 45–60% by weight and typically is from 50% to about 55% by weight. Some commercial OCP's are terpolymers of ethylene, propylene and a small amount of non-conjugated diene such as 1,4-hexadiene. In the rubber industry, such terpolymers are referred to as EPDM (ethylene propylene diene monomer).

Esters obtained by copolymerizing styrene and maleic anhydride in the presence of a free radical initiator and thereafter esterifying the copolymer with a mixture of $C_{4-18}$ alcohols also are useful as viscosity-modifying additives.

The hydrogenated styrene-conjugated diene copolymers are prepared from styrenes such as styrene, alpha-methyl styrene, ortho-methyl styrene, meta-methyl styrene, para-methyl styrene, para-tertiary butyl styrene, etc. Preferably the conjugated diene contains from 4 to 6 carbon atoms. Examples of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The styrene content of these copolymers is in the range of about 20% to about 70% by weight, preferably about 40% to about 60% by weight. The aliphatic conjugated diene content of these copolymers is in the range of about 30% to about 80% by weight, preferably about 40% to about 60% by weight.

These copolymers can be prepared by methods well known in the art. Such copolymers usually are prepared by anionic polymerization using, for example, an alkali metal hydrocarbon (e.g., sec-butyllithium) as a polymerization catalyst. Other polymerization techniques such as emulsion polymerization can be used.

These copolymers are hydrogenated in solution so as to remove a substantial portion of their olefinic double bonds. Techniques for accomplishing this hydrogenation are well known to those of skill in the art and need not be described in detail at this point. Briefly, hydrogenation is accomplished by contacting the copolymers with hydrogen at super-atmospheric pressures in the presence of a metal catalyst such as colloidal nickel, palladium supported on charcoal, etc.

In general, it is preferred that these copolymers, for reasons of oxidative stability, contain no more than about 5% and preferably no more than about 0.5% residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the afore-mentioned analytical techniques.

These copolymers typically have number average molecular weights in the range of about 30,000 to about 500,000, preferably about 50,000 to about 200,000. The weight average molecular weight for these copolymers is generally in the range of about 50,000 to about 500,000, preferably about 50,000 to about 300,000.

The above-described hydrogenated copolymers have been described in the prior art. For example, U.S. Pat. No. 3,554,911 describes a hydrogenated random butadiene-styrene copolymer, its preparation and hydrogenation. The disclosure of this patent is incorporated herein by reference. Hydrogenated styrene-butadiene copolymers useful as viscosity-modifiers in the ER fluids of the present invention are available commercially from, for example, BASF under the general trade designation "Glissoviscal". A particular example is a hydrogenated styrene-butadiene copolymer available under the designation Glissoviscal 5260 which has a number average molecular weight of about 120,000. Hydrogenated styrene-isoprene copolymers useful as viscosity modifiers are available from, for example, The Shell Chemical Company under the general trade designation "Shellvis"Shellvis 40 from Shell Chemical Company is identified as a diblock copolymer of styrene and isoprene having a number average molecular weight of about 155,000, a styrene content of about 19 mole percent and an isoprene content of about 81 mole percent. Shellvis 50 is available from Shell Chemical Company and is identified as a diblock copolymer of styrene and isoprene having a number average molecular weight of about 100,000, a styrene content of about 28 mole percent and an isoprene content of about 72 mole percent.

The following examples illustrate some of the ER fluids of the present invention. Silicone oil (10 cst) is a polydimethyl silicone oil from Dow Corning.

| | %/Wt. |
|---|---|
| ER Fluid A | |
| Polypyrrole salt of Ex. 10 | 15.0 |
| Glycerol monooleate | 3.0 |
| Trisun 80 | 82.0 |
| ER Fluid B | |
| Polyvinylidene fluoride | 20.0 |
| EXP-69 silicone | 3.0 |
| Silicone oil (10 cst) | 77.0 |
| ER Fluid C | |
| Polyphenylene sulfide | 40.0 |
| Emery 3004 | 60.0 |
| ER Fluid D | |
| Polypyrrole salt of Ex. 11 | 15.0 |
| EXP-69 | 3.0 |
| Silicone oil (10 cst) | 82.0 |
| ER Fluid E | |
| Poly-2-vinylpyridine | 15.0 |
| EXP-69 | 3.0 |
| Silicone oil (10 cst) | 82.0 |
| ER Fluid F | |
| Poly-o-toluidine of Ex. 1 | 20.0 |
| Glycerol monooleate | 3.0 |
| Emery 3004 | 77.0 |
| ER Fluid G | |
| Poly-m-toluidine of Ex. 4 | 15.0 |
| PS563 (carboxy terminated silicone) | 3.0 |
| Silicone oil (10 cst) | 82.0 |
| ER Fluid H | |
| Polyvinylpyridine (Reilline 2200) | 17.0 |
| Silicone oil (10 cst) | 83.0 |
| ER Fluid I | |
| Poly-p-phenylene sulfide of Ex. 23 | 25.0 |
| Glycerol monooleate | 3.0 |
| Trisun 80 | 72.0 |
| ER Fluid J | |
| Poly-2-vinylpyridine/$I_2$(2.7%I) | 15.0 |
| EXP 69 silicone | 3.0 |
| Silicone oil (10 cst) | 82.0 |
| ER Fluid K | |
| Product of Ex. 19 | 15.0 |
| EXP 69 silicone | 3.0 |
| Silicone oil (10 cst) | 82.0 |
| ER Fluid L | |
| Polypyrrole lauryl sulfate (Ex. 13) | 20.0 |
| Glycerol monooleate | 5.0 |
| Trisun 80 | 75.0 |
| ER Fluid M | |
| KOH treated polypyrrole lauryl sulfate (Ex. 14) | 20.0 |
| Glycerol monooleate | 3.0 |
| Trisun 80 | 77.0 |
| ER Fluid N | |
| Poly-o-toluidine of Ex. 1 | 20.0 |
| Ethylene glycol | 3.0 |
| Trisun 80 | 77.0 |
| ER Fluid O | |
| Poly-o-toluidine of Ex. 1 | 25.0 |
| EXP 69 silicone | 3.0 |
| Silicone oil (10 cst) | 72.0 |
| ER Fluid P | |
| Poly-o-toluidine of Ex. 1 | 25.0 |
| EXP 69 silicone | 3.0 |
| Ethylene glycol | 1.0 |
| Silicone oil (10 cst) | 71.0 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

EXAMPLE 24

To a 12 L flask is charged 3 L distilled water, 4 15 mL aqueous hydrochloric acid (83 mL/mole), and 535 g N-methylaniline. The flask and its contents are cooled to 4° C. and a solution of 1140 g ammonium persulfate in 3500 mL distilled water is added over 6 hours (temperature 4°–10° C.). The mixture is stirred overnight at room temperature.

The solids are recovered by filtration, then returned to a flask and slurried with 3 L distilled water and stirred overnight.

The solids are recovered by filtration and slurried in 6 L distilled water containing 330 mL concentrated ammonium hydroxide (66 mL/mole) and stirred at room temperature overnight.

The solids are recovered by filtration and slurried in 3 L distilled water and stirred at room temperature overnight.

The solids are recovered by filtration dried in a steam oven, sieved through a 710 μm mesh screen, and dried at 100° C. under vacuum.

The resulting poly-N-methylaniline is formulated into an electrotheological fluid.

What is claimed is:

1. A non-aqueous electrorheological fluid comprising a hydrophobic liquid phase and a dispersed particulate phase comprising conductive polymers selected from the group consisting of poly-alkylanilines, poly-sulfonic acid-substituted anilines, poly-carboxylic acid-substituted anilines, poly-phenylanilines, and poly-hydroxyanilines.

2. The electrorheological fluid of claim 1 wherein the polyalkylanilines are polymethylanilines.

3. The electrorheological fluid of claim 1 wherein the polymer is a homopolymer.

4. The electrorheological fluid of claim 1 wherein the conductive polymer is prepared by polymerizing at least one substituted aniline in the presence of an amount of an oxidizing agent effective to effect polymerization thereof and an acid to form an acid salt of the poly(substituted aniline).

5. The electrorheological fluid of claim 4 wherein the substituted aniline is polymerized in the presence of an oxidizing agent and from about 0.1 to about 2 moles of an acid per mole of substituted aniline.

6. The electrorheological fluid of claim 4 wherein about 0.8 to about 2 moles of the oxidizing agent are present per mole of substituted aniline.

7. The electrorheological fluid of claim 4 wherein the acid is a mineral acid.

8. The electrorheological fluid of claim 7 wherein the mineral acid is hydrochloric acid.

9. The electrorheological fluid of claim 4 wherein the acid is an organic acid.

10. The electrorheological fluid of claim 9 wherein the organic acid is a sulfonic, sulfinic, carboxylic or phosphorus acid.

11. The electrorheological fluid of claim 9 wherein the organic acid is an alkyl sulfonic acid, an aryl sulfonic acid, an alkyl carboxylic acid, or an aryl carboxylic acid.

12. The electrorheological fluid of claim 9 wherein the organic acid is (a) a sulfo acid monomer represented by the formula $$(R_1)_2C{=}C(R_1)Q_aZ_b \quad \text{(III)}$$

wherein each $R_1$ is independently hydrogen or a hydrocarbyl group; a is 0 or 1; b is 1 or 2, provided that when a is 0, then b is 1;

Q is a divalent or trivalent hydrocarbyl group or $C(X)NR_2Q'$;

each $R_2$ is independently hydrogen or a hydrocarbyl group;

Q' is a divalent or trivalent hydrocarbyl group;

X is oxygen or sulfur; and

Z is S(O)OH, or $S(O)_2OH$; or (b) a polymer of at least one of said monomers.

13. The electrorheological fluid of claim 12 wherein the organic acid is (b) a polymer of at least one of said sulfo monomers.

14. The electrorheological fluid of claim 12 wherein: a and b are 1; Q is $C(X)NR_2Q'$; X is oxygen; Q' is an alkylene group having 1 to about 18 carbon atoms; and Z is $S(O)_2OH$.

15. The electrorheological fluid of claim 12 wherein the polymer (b) is an interpolymer of the sulfo monomer (a) and at least one comonomer selected from the group consisting of acrylic compounds; maleic acids, anhydrides or salts; vinyl lactones; vinyl pyrrolidones; and fumaric acids or salts.

16. The electrotheological fluid of claim 4 wherein the oxidizing agent is a metal or ammonium persulfate.

17. The electrorheological fluid of claim 4 wherein the oxidizing agent is ammonium persulfate.

18. The electrorheological fluid of claim 4 wherein the salt of the poly(substituted aniline) is treated with a base.

19. The electrorheological fluid of claim 18 wherein the base is ammonium hydroxide, an alkali metal oxide, an alkaline earth metal oxide, an alkali metal hydroxide, an alkaline earth metal hydroxide, an alkali metal alkoxide, an alkaline earth metal alkoxide, an alkali metal carbonate, or an alkaline earth metal carbonate.

20. The electrorheological fluid of claim 18 wherein the poly(substituted aniline) acid salt is treated with an amount of the base for a period of time sufficient to remove substantially all of the protons derived from the acid.

21. The electrorheological fluid of claim 20 wherein the poly(substituted aniline) which is substantially free of acidic protons is treated with an amount of an acid, halogen, sulfur, sulfur halide, sulfur oxide, or hydrocarbyl halide, or mixtures thereof to form a compound having a desired conductivity.

22. The electrorheological fluid of claim 21 wherein the acid is a mineral acid, Lewis acid or an organic acid, or mixtures thereof.

23. The electrorheological fluid of claim 21 wherein the acid is an organic monosulfonic, polysulfonic, monosulfinic, polysulfinic, monocarboxylic, polycarboxylic, monophosphorus, or polyphosphorus acid or mixtures thereof.

24. The electrorheological fluid of claim 23 wherein the organic acid is an alkyl or aryl mono or polysulfonic or carboxylic acid, or mixtures thereof.

25. The electrorheological fluid of claim 21 wherein the poly(substituted aniline) which is substantially free of acidic protons is treated with (a) a sulfo acid monomer represented by the formula $$(R_1)_2C{=}C(R_1)Q_aZ_b \quad \text{(III)}$$

wherein each $R_1$ is independently hydrogen or a hydrocarbyl group; a is 0 or 1; b is 1 or 2, provided that when a is 0, then b is 1;

Q is a divalent or trivalent hydrocarbyl group or $C(X)NR_2Q'$;

each $R_2$ is independently hydrogen or a hydrocarbyl group;

Q' is a divalent or trivalent hydrocarbyl group;

X is oxygen or sulfur; and

Z is S(O)OH, or $S(O)_2OH$; or (b) a polymer of at least one of said monomers.

26. The electrorheological fluid of claim 25 wherein the organic acid is (b) a polymer of at least one of said sulfo acid monomers.

27. The electrorheological fluid of claim 26 wherein: a and b are 1; Q is $C(X)NR_2Q'$; X is oxygen; Q' is an alkylene group having 1 to about 18 carbon atoms; and Z is $S(O)_2OH$.

28. The electrorheological fluid of claim 21 wherein the poly(substituted aniline) which is substantially free of acidic protons is treated with iodine.

29. The electrorheological fluid of claim 21 wherein the poly(substituted aniline) which is substantially free of acid protons is treated with a mineral acid.

30. The electrorheological fluid of claim 29 wherein the mineral acid is hydrochloric acid.

31. The electrorheological fluid of claim 21 wherein the poly(substituted aniline) which is substantially free of acidic protons is treated with a Lewis acid.

32. The electrorheological fluid of claim 30 wherein the poly(substituted aniline) is treated with an amount of hydrochloric acid sufficient to provide a salt containing from 0.01 to about 1% chlorine.

33. The electrorheological fluid of claim 4 wherein the poly(substituted aniline) is prepared by polymerizing at least one substituted aniline in the presence of approximately equimolar amounts of the acid and the oxidizing agent.

34. The electrorheological fluid of claim 4 wherein the poly(substituted aniline) is prepared by adding an aqueous solution of the oxidizing agent to an aqueous mixture of substituted aniline and acid while maintaining the temperature of the reaction below about 50° C.

35. The electrorheological fluid of claim 34 wherein the temperature of the reaction is maintained below about 10° C.

36. The electrorheological fluid of claim 34 wherein the acid is a mineral acid and the oxidizing agent is a metal or ammonium persulfate.

37. The electrorheological fluid of claim 4 wherein the poly(substituted aniline) is prepared from a mixture of at least one substituted aniline and up to about 50% by weight of aniline, a pyrrole, vinylpyridine, vinylpyrrolidone, thiophene, vinylidene halide, phenothiazine, imidazole, N-phenyl-p-phenylene diamine or mixtures thereof.

38. The electrorheological fluid of claim 37 wherein the poly(substituted aniline) is prepared from a mixture of at least one substituted aniline and up to about 50% by weight of a pyrrole.

39. The electrorheological fluid of claim 1 also containing at least one organic polar compound selected from the group consisting of amines, amides, nitriles, alcohols, polyhydroxy compounds, and ketones.

40. The electrorheological fluid of claim 39 wherein the organic polar compound is a polyhydroxy compound.

41. The electrotheological fluid of claim 1 also containing at least one surfactant.

42. The electrorheological fluid of claim 8 wherein the hydrochloric acid salt of the poly(substituted aniline) is treated with ammonium hydroxide or an alkali metal hydroxide for a period of time sufficient to reduce the chloride content of the poly-substituted aniline to 0 to 0.2%.

43. The electrorheological fluid of claim 42 wherein the poly(substituted aniline) thus obtained is treated with a mineral acid in an amount sufficient to form a salt having the desired level of conductivity.

44. The electrorheological fluid of claim 42 wherein the mineral acid is hydrochloric acid.

45. The electrorheological fluid of claim 42 wherein the poly(substituted aniline) thus obtained is treated with iodine in amounts sufficient to form a compound having the desired level of conductivity.

46. The electrorheological fluid of claim 42 wherein the poly(substituted aniline) thus obtained is treated with a Lewis acid in amounts sufficient to form a product having the desired level of conductivity.

47. The electrorheological fluid of claim 1 wherein the conductive polymer is prepared in the presence of a solid substrate.

48. The electrorheological fluid of claim 47 wherein the solid substrate is cellulose or a zeolite.

49. A clutch, valve or damper containing the electrorheological fluid of claim 1.

50. The electrorheological fluid of claim 1 wherein the hydrophobic liquid phase comprises an ester.

51. The electrorheological fluid of claim 47 wherein the solid substrate is cellolose.

* * * * *